US008695670B2

(12) United States Patent
Barczyk et al.

(10) Patent No.: US 8,695,670 B2
(45) Date of Patent: Apr. 15, 2014

(54) LABEL SHEET AND LABEL SHEET MANUFACTURING DEVICE

(75) Inventors: Victor S. Barczyk, Lone Tree, CO (US); Klaus Horn, Wuppertal (DE); Martin Wellsandt, Mainz (DE)

(73) Assignee: Sato Holdings Kabushiki Kaisha (JP)

( * ) Notice: Subject to any disclaimer, the term of this patent is extended or adjusted under 35 U.S.C. 154(b) by 249 days.

(21) Appl. No.: 12/744,209

(22) PCT Filed: Feb. 22, 2008

(86) PCT No.: PCT/JP2008/053073

§ 371 (c)(1),
(2), (4) Date: May 21, 2010

(87) PCT Pub. No.: WO2009/075117

PCT Pub. Date: Jun. 18, 2009

(65) Prior Publication Data

US 2010/0247871 A1 Sep. 30, 2010

(30) Foreign Application Priority Data

Dec. 11, 2007 (JP) ..... 2007-320123

(51) Int. Cl.
*B32B 41/00* (2006.01)

(52) U.S. Cl.
USPC ..... 156/360; 156/361; 156/367; 156/368

(58) Field of Classification Search
USPC ..... 156/360, 361, 367, 368, 442.1, 443, 156/522
See application file for complete search history.

(56) References Cited

U.S. PATENT DOCUMENTS 5,800,894 A * 9/1998 Navis ..... 428/41.7
6,350,342 B1 * 2/2002 Steidinger et al. ..... 156/257

(Continued)

FOREIGN PATENT DOCUMENTS

| | | |
|---|---|---|
| EP | 1 632 926 | 3/2006 |
| JP | 2000-3941 | 6/2000 |
| JP | 2001-302992 | 10/2001 |
| JP | 2002-1424 | 3/2002 |

(Continued)

OTHER PUBLICATIONS

International Search Report for International Application No. PCT/JP2008/053073 mailed May 27, 2008.

(Continued)

*Primary Examiner* — George Koch
(74) *Attorney, Agent, or Firm* — Ostrolenk Faber LLP

(57) ABSTRACT

A label and label attaching device for attaching a label onto a backing sheet. The label has a protruding apex portion, side surfaces defined when the label is folded at the apex and end portions at the outer base ends of the side surfaces. A label sheet is formed by temporarily attaching labels to a backing sheet. Prior to attachment, an intermediate portion of the label protrudes from its back surface to its front surface in a folded chevron shape. Outer end portions of the side surfaces project out from the side surfaces and the outer end portions are temporarily attached to the backing sheet with the folded portion protruding. The attaching device has two divided bodies to which the outer end portions are temporarily attracted. The divided bodies are movable together and apart to define the folded label. Then the label holding unit moves the folded label to an attaching position on the backing sheet which is moving past.

11 Claims, 7 Drawing Sheets

(56) References Cited

U.S. PATENT DOCUMENTS

| | | | | |
|---|---|---|---|---|
| 6,627,033 | B1 * | 9/2003 | Dexter | 156/260 |
| 6,656,558 | B1 * | 12/2003 | Sarajian | 428/42.2 |
| 7,703,685 | B2 * | 4/2010 | Horn et al. | 235/486 |
| 7,969,309 | B2 * | 6/2011 | Abe et al. | 340/572.1 |
| 8,020,598 | B2 * | 9/2011 | Kirita et al. | 156/360 |
| 8,151,850 | B2 * | 4/2012 | Murakami | 156/361 |
| 2004/0238098 | A1 * | 12/2004 | Bleckmann et al. | 156/73.1 |
| 2005/0167044 | A1 * | 8/2005 | Exeter et al. | 156/302 |
| 2006/0226214 | A1 * | 10/2006 | Horn et al. | 235/375 |

FOREIGN PATENT DOCUMENTS

| | | |
|---|---|---|
| JP | 3088661 | 7/2002 |
| JP | 2004-51180 | 2/2004 |
| JP | 2006-277524 | 10/2006 |
| WO | WO 2007/032360 | 3/2007 |

OTHER PUBLICATIONS

International Search Report mailed May 27, 2008 in corresponding PCT International Application No. PCT/JP2008/053073.

* cited by examiner

LABEL SHEET AND LABEL SHEET MANUFACTURING DEVICE

CROSS REFERENCE TO RELATED APPLICATION

The present application is a 35 U.S.C. §§371 national phase conversion of PCT/JP2008/053073, filed Feb. 22, 2008, which claims priority of Japanese Patent Application No. 2007-320123, filed Dec. 11, 2007, the content of which is incorporated herein by reference. The PCT International Application was published in the Japanese language.

TECHNICAL FIELD

The present invention relates to a label sheet comprised of labels which are to be applied to various sorts of articles and which are temporarily attached to a backing sheet in a detachable manner. The present invention also relates to a label sheet manufacturing device for manufacturing the label sheet, comprised of labels which can be temporarily attached to a backing sheet and a portion of the label protrudes from the back surface side to the front surface side defining a chevron shape, and which label can be peeled off from the backing sheet and applied to the article by manual procedures.

BACKGROUND ART

As shown in FIG. 7, a label L has a portion 2 of the label L that protrudes due to folding the label L from the back surface side to the front surface side in a chevron shape and the label is attached to an article. This is conventionally known. The label L is of a rectangular shape. It includes a folded portion 1 formed by folding which causes protrusion of an intermediate portion of the label from its back surface side to its front surface side in a chevron shape. The folded label has a first side surface 4 (one side surface 4) and a second side surface 5 (other side surface 5) and an apex portion 3 provides a border therebetween. It has outer end portions 7 protruding respectively from a base portion of the first side surface 4 and from a base portion of the second side surface 5 of the folded portion 1 at a respective bent portion 6 between each side surface 4 and 5 and its end portion 7.

The label L is provided with glue on its back surface. Before the label is attached to an article, a plurality of the labels, then in a planar state, are provided in rows on a strip form backing sheet 8, which forms a planar label sheet 9. The strip form backing sheet 8 is comprised of a central backing sheet 8*a*, in the center, where the first side surface 4 and the second side surface 5 are temporarily attached, and a pair of end backing sheets 8*b* to which both outer end portions 7 are temporarily attached.

To attach this label L to the article, by manual procedures, first, the central backing sheet 8*a* is peeled from the label L. Then sequentially the label L is peeled from the end backing sheets 8*b*. Then the label L is folded at the apex portion 3 and the bent portions 6, to form a folded portion 1, which is attached to the article by the outer end portions 7. (See for example, Japanese Utility Model Application, First Publication No. 3073917).

SUMMARY OF INVENTION

Technical Problem

Such a label L is attached to an article by a manual procedure. However, as the label L is in a planar shape and is temporarily attached to the backing sheet 8, after the label L is peeled from the backing sheet 8, it is necessary to fold the labels L one by one at the apex portion 3 and at the bent portions 6 to form the folded portion 1, and then to attach the label to the article. Therefore, because of the work of folding the label L, the attaching procedure is cumbersome and complicated.

Accordingly, the present invention has been made in view of the aforementioned problem. It is an object of the present invention to provide a label sheet, which facilitates the attaching procedure such that, when a label is attached to an article, it is possible to attach the label with a portion of the label protruding in a chevron shape towards the article, even without having to perform folding procedure the label, and it is an object to provide a label sheet manufacturing device for such a label sheet.

Solution to Problem

In order to solve the aforementioned problems, the label sheet of the present invention is proposed with the following arrangements.

A label sheet includes a label temporarily attached to a backing sheet in a detachable manner. A folded portion of the label is formed by folding and protruding an intermediate portion of the label from its back surface side to its front surface side in a chevron shape, forming a first side surface and a second side surface with an apex portion as a border between them. Outer end portions protrude respectively from a base portion of the first side surface and from a base portion of the second side surface of the folded portion at bent portions. These outer end portions are temporarily attached to the backing sheet with the folded portion in a protruding state.

Accordingly, to attach a label to an article, the label is peeled from the backing sheet, and then the outer end portions of the label are attached to the article by manual procedures. In this case, as the apex portion and the bent portions of the label are folded in advance of forming the folded portion the label is temporarily attached to the backing sheet with the folded portion of the label in a protruding state. Therefore, the attaching procedure of the label does not require performing the folding procedure one by one on labels as in the past. It is only required to attach the outer end portions of the labels to the article as they are, so that the attaching procedure can be easily performed.

Furthermore, the label sheet of the present invention is configured to enable a label sheet manufacturing device to manufacture a label sheet with the label temporarily attached to a backing sheet in a detachable manner, wherein a folded portion of the label is formed by folding and protruding an intermediate portion of the label from back surface side to front surface side in a chevron shape, wherein the label has a first side surface and a second side surface with an apex portion as a border between them, and wherein outer end portions of the label protruding respectively from a base portion of the first side surface and from a base portion of the second side surface of the folded portion at bent portions of the label, are temporarily attached to the backing sheet with the folded portion in a protruding state.

The label sheet manufacturing device comprises a label supply unit which supplies a planar state label; a label holding unit which attracts and holds the label supplied from the label supply unit; a backing sheet conveyance unit which conveys the backing sheet; a folding and temporary attaching unit, which forms a folded portion of the label by folding and protruding a portion of the label from back surface side to front surface side in a chevron shape, the label having a first side surface and a second side surface with an apex portion as a border between them, and wherein outer end portions protruding respectively from a base portion of the first side surface and from a base portion of the second side surface of the folded portion at bent portions, are temporarily attached to the backing sheet conveyed by the backing sheet conveyance unit.

Accordingly, in manufacturing a label sheet, as the planar label is supplied by the label supplying unit, the label holding unit holds the label and the folding and temporary attaching unit forms the folded portion by folding and protruding a portion of the label from back surface side to front surface side in a chevron shape, having a first side surface and a second side surface with an apex portion as a border between them. Then, the outer end portions, protruding respectively from the folded portion at the bent portions, are temporarily attached to the backing sheet conveyed by the backing sheet conveyance unit. Therefore, it is possible to easily manufacture the label sheet with the label, including the folded portion temporarily attached to the backing sheet with the folded portion in a protruding state.

When a label manufactured in this manner is attached to an article, as in the same way as above, the label is peeled from the backing sheet and the outer end portions are attached to the article by manual procedures. In this case, the label is formed with the apex portion and the bent portions of the label, folded in advance, forming the folded portion, and the label is temporarily attached to the backing sheet with the folded portion in a protruding state. Therefore, during the attaching procedure of the label, it is not required to perform the folding procedure of labels one by one, as was done in the past, but it is only required to attach the outer end portions to the article as they are, such that the attaching procedure can be easily performed.

Furthermore, the label sheet manufacturing device, where necessary, comprises the label holding unit which is configured to comprise a pair of divided bodies for attracting and holding the label. The folding and temporary attaching unit is configured to comprise a folding unit which causes relative approach and separation of the divided bodies, and at approach of the divided bodies, forms the folded portion by pressing on the bent portions of the label, and also forms the end of the portion. Each divided body is opposing and folding a part of the label. A movement control unit controls the movement of the divided bodies of the folding unit.

Accordingly, when temporarily attaching a label to a backing sheet, a pair of divided bodies of the label holding unit attracts and holds the label, and each of the pair of divided bodies then approaches the other from the separated position by action of the folding and temporary attaching unit. At this approach, the bent portions of the label are pressed by the end surfaces of the label opposing each divided bodies, and the portion of the label is folded forming the folded portion. Then, in this state, the label is attached to the backing sheet. Because of this process, the folding and temporary attaching procedure can be performed extremely easily by the folding and temporary attaching unit causing protrusion of a portion of the label in a chevron shape and automatically temporarily attaching the label to the backing sheet. Because the label sheet manufacturing device is provided with a movement control unit which controls the movement of the divided bodies of the folding unit, at separation of the divided bodies, the portion of the label corresponding to the folded portion may be positioned between the pair of divided bodies. Therefore, at approach, the outer end portions of the label are brought into contact with the divided bodies, whereby the portion of the label may be folded securely at the bent portions, securely performing label attachment.

In this case, it is effective for the movement control unit to position the moving divided bodies at a contacting position where the divided bodies contact each other when the label supplied from the label supplying unit is attracted and held, to a separating position where the divided bodies separate from one another enabling folding of the label, and to a folded portion forming position where the divided bodies approximate/approach one another from the separating position forming the folded portion. According to the setting manner of the folded portion forming position it is possible to change the attaching manner of the label. For example, by attaching the label by forming a space between the first side surface and the second side surface of the label, in an inverted V-shape, or by attaching the label by joining the first side surface and the second side surface, etc.

Furthermore, the label sheet manufacturing device comprising the backing sheet conveyance unit is configured, where necessary, to comprise a backing sheet reel holding unit which holds the backing sheet reel with the strip form backing sheet wound around rotatably, and a strip form backing sheet conveyance mechanism which pulls out the strip form backing sheet from the backing sheet reel held by the backing sheet holding unit and conveys the strip form backing sheet. Accordingly, it is possible to sequentially temporarily attach the label to the strip form backing sheet with the folded portion in a protruded state, thereby improving the manufacturing efficiency.

In this case, where necessary, at a downstream side of the strip form backing sheet conveyance mechanism, the label sheet manufacturing device is provided with a cutting mechanism, which cuts the strip form backing sheet to which the label is temporarily attached into a predetermined length. Accordingly, as the label sheet is manufactured with each one label or with each set of plurality of labels, it is possible to facilitate the handling.

Furthermore, where necessary, the folding and temporary attaching unit comprises a transferring unit which transfers the label holding unit between two positions, the attracting and holding position where the label is attracted and held by the label holding unit, and the temporary attaching position where the attracted and held label is temporarily attached on the backing sheet.

In this case, for a label sheet manufacturing device using the strip form backing sheet, it is effective to provide the folding and temporary attaching unit with a transferring unit which transfers the label holding unit to the two positions, the attracting and holding position where the label is attracted and held, and the temporary attaching position where the attracted and held label is temporarily attached to the strip form backing sheet; to set the temporary attaching position at a downstream side of the conveying direction of the strip form backing sheet with regard to the attracting and holding position; and the transferring unit to transfer the label holding unit from the attracting and holding position towards the temporary attaching position in an oblique direction. As the label holding unit is transferred from the attracting and holding position toward the temporary attaching position in an oblique direction, the label holding unit moves away from the label supplying unit. Therefore, compared to a case where the label holding unit is transferred in a vertical direction, it is possible to reliably prevent interference with the label supplying unit.

Advantageous Effects of Invention

According to the present invention, when attaching a label to an article, it is possible to peel off the label from the backing sheet and attach the label on the article as by manual procedures. In this case, the label is formed with the apex portion and the bent portions of the label, folded in advance, forming the folded portion, and the label is temporarily attached to the backing sheet with the folded portion in a protruding state. Therefore, in the attaching procedure of the label, it is not required to perform the folding procedure one by one as in the past. Instead, it is only required to attach the outer end portions of the label to the article as they are, such that the attaching procedure can be extremely easily performed and the work efficiency of attaching the label can be improved considerably.

BRIEF DESCRIPTION OF DRAWINGS

FIG. 2(*a*) is a diagram showing the operation of the label sheet manufacturing device in the embodiment of the present invention.

FIG. 2(*b*) is a diagram showing the operation of the label sheet manufacturing device in the embodiment of the present invention.

FIG. 2(*c*) is a diagram showing the operation of the label sheet manufacturing device in the embodiment of the present invention.

FIG. 3(*a*) is a diagram showing the operation of the label sheet manufacturing device in the embodiment of the present invention.

FIG. 3(*b*) is a diagram showing the operation of the label sheet manufacturing device in the embodiment of the present invention.

FIG. 3(*c*) is a diagram showing the operation of the label sheet manufacturing device in the embodiment of the present invention.

DESCRIPTION OF EMBODIMENTS

Hereinafter, a label sheet manufacturing device according to the embodiments of the present invention is described in detail based on the attached figures.

Figure 1:
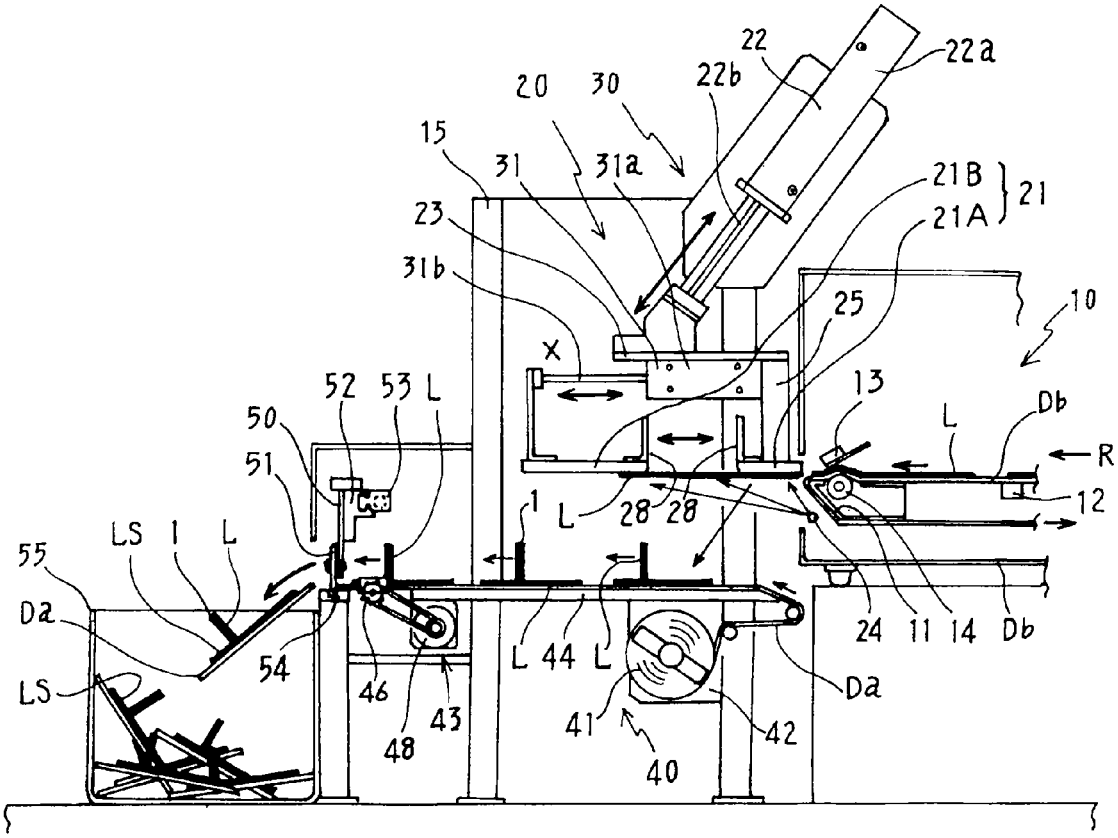
FIG. 1 is a diagram showing an embodiment of the label sheet manufacturing device of the present invention.
Figure 4:
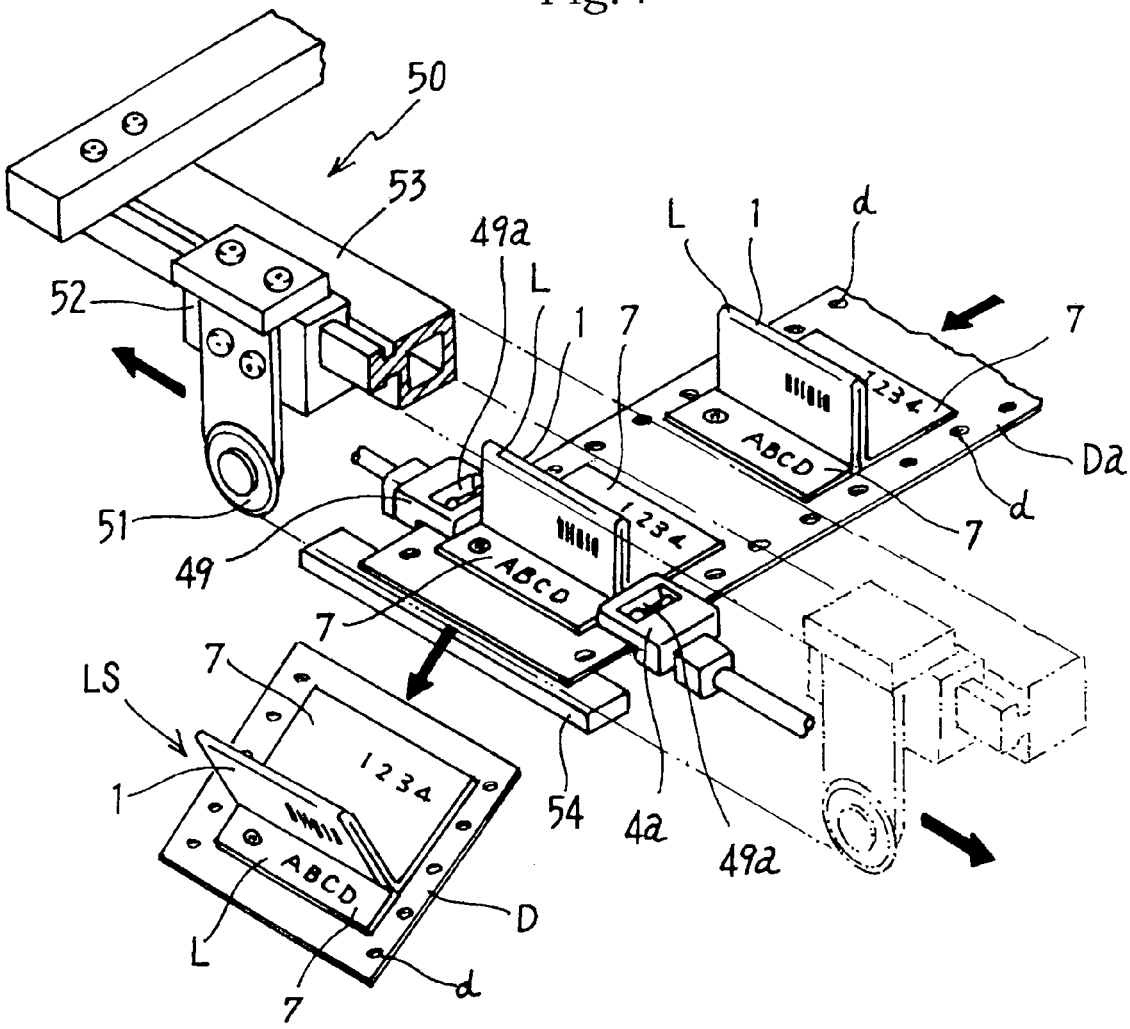
FIG. 4 is a perspective view diagram showing the cutting mechanism of the label sheet manufacturing device in the embodiment of the present invention.
Figure 6:
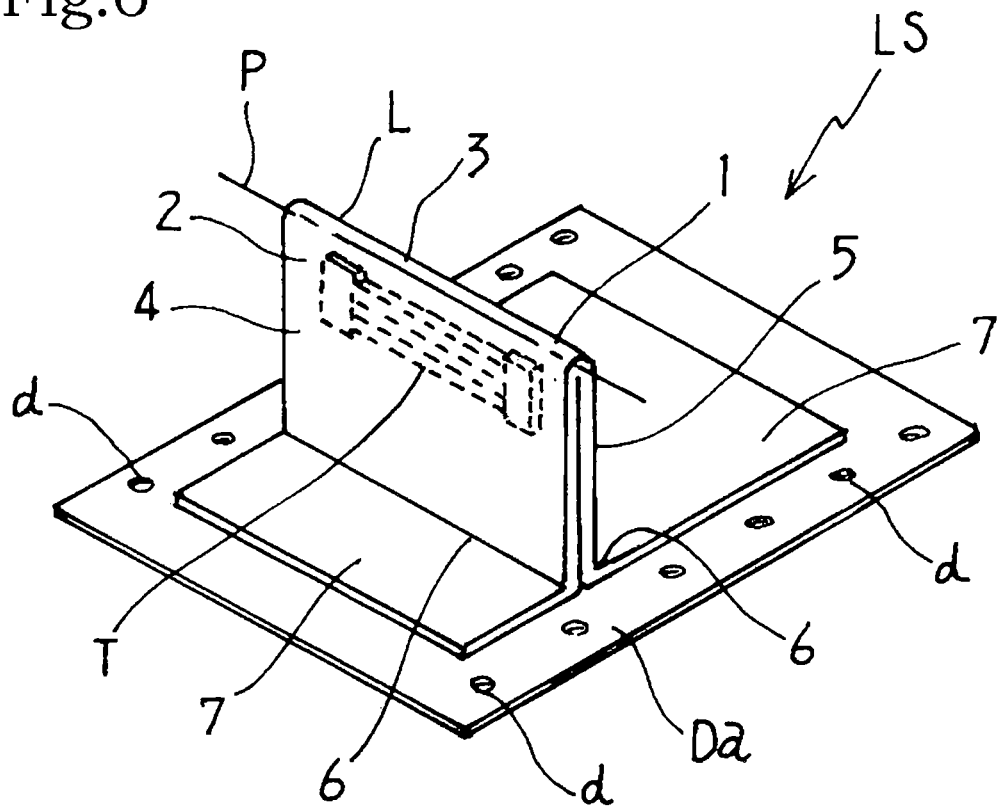
FIG. 6 is a perspective view diagram showing the label sheet in the embodiment of the present invention.
Figure 7:
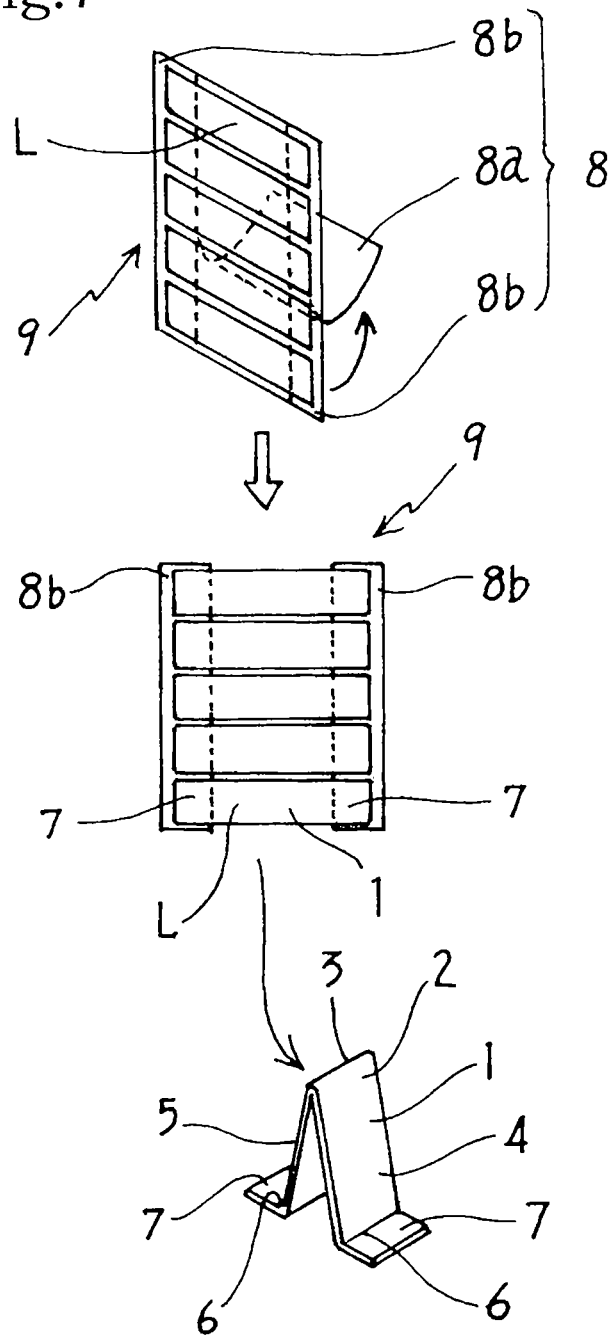
FIG. 7 is a diagram showing an example of the conventional label sheet.

FIGS. 1, 4 and 6 show a label sheet LS in an embodiment of the present invention. The label sheet LS is formed with a label L temporarily attached to a backing sheet D. The label L in this embodiment is rectangular in shape, and includes a folded portion 1 formed by folding and forming a protruding portion 2 in the middle of the label, from its back surface side to its front surface side in a chevron shape, and having a first outward facing side surface 4 and a second opposite outward facing side surface 5 with an apex portion 3 as a border between the side surfaces. It has opposite outwardly directed outer end portions 7 protruding respectively from a base portion of the first side surface 4 and from a base portion of the second side surface 5 of the folded portion 1 at bent portions 6. The label L has applied to it an adhesive only on the back surface side surface of the outer end portions 7 or on the entire back surface side surface. The outer end portions 7 are temporarily attached to the backing sheet D, with the folded portion 1 in a protruding state, that is, with the folded portion 1 folded and rising upward in advance.

Furthermore, in the embodiment, on at least one of either the first side surface 4 or the second side surface 5 of the label L, for example, an RFID (Radio Frequency Identification) tag T is provided. The RFID tag T, is comprised of an IC (Integrated Circuit) chip which stores various information, and an antenna for communication which is connected to the IC chip, and is a design prevailing in the recent years. Needless to say, in the present invention, the label L is not limited to a label L with an RFID tag T, but it can also be a label L without an RFID tag T.

Still furthermore, at the folding lines P at the apex portion 3 and the bent portions 6, perforations may be formed. In addition, the label L of the label sheet LS of this embodiment is not necessarily rectangular in shape, but it may be in various other shapes such as a label with an intermediate portion of the label in a variant form.

Furthermore, the backing sheet D is formed by cutting a strip form backing sheet Da, for example, by a length of one label L or by a length of a set of a plurality of labels L accordingly. In this embodiment, the backing sheet D is formed of a predetermined length such that some blank space is left, corresponding to each one label L. At both end edge portions along the longitudinal direction of the strip form backing sheet Da, holes d, in which later mentioned pins of a feed roller are inserted, are provided at predetermined intervals.

Next, a label sheet manufacturing device according to an embodiment of the present invention is described. As shown in FIGS. 1 through 5, the label sheet manufacturing device is provided with a label supplying unit 10 which supplies planar labels L.

Figure 2:
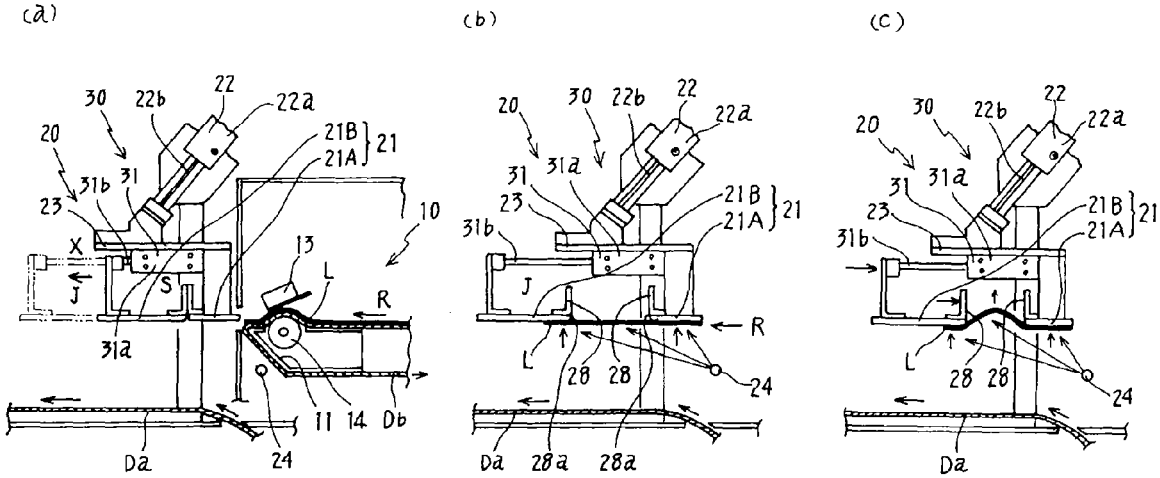
FIG. 2 show a series of stages of operation of the manufacturing device.

The label L, at first, is temporarily attached in a line onto the strip form base backing sheet Dd in a planar state as shown in FIGS. 1 and 2 (*a*). The label L is temporarily attached onto the strip form base backing sheet with the as yet unfolded folding lines P (shown in FIG. 6) of the apex portion 3 and the bent portions 6 perpendicular to the longitudinal direction (the supplying direction R of the label L) of the strip form base backing sheet Dd.

The label supplying unit 10, as shown in FIGS. 1 and 2 (*a*), sends the label L by peeling off the label L from the strip form base backing sheet Db on which the label L was temporarily attached in a planar state. Then the label supply unit 10, by a peel-off board 11, peels off the label L from the strip form base backing sheet Db which was supplied to the conveyance route from a not shown supply reel. Then the label supplying unit 10 takes up the strip form base backing sheet Db, on which the label L is peeled off, by a not shown take-up reel. The peel-off board 11, by folding back the strip form base backing sheet Db conveyed through the conveyance route of the strip form base backing sheet Db, peels off the label L, which has greater rigidity than that of the strip form base backing sheet Db, and this from the strip form base backing sheet Db, feeds out and supplies the label L. In the diagram, a reader/writer 12 rewrites the data on the IC chip of the RFID tag T and also performs a verification, etc. by writing and reading of information. A thermal head 13 prints on the label L then on a platen 14 which is shown in the form of a roller.

Furthermore, the label sheet manufacturing device is provided with a label holding unit 20 which attracts and holds the label L supplied from the label supplying unit 10. The label holding unit 20 is provided with an attracting and holding board 21 which attracts and holds the front surface side of the label L peeled off by the peel-off board 11. At the attracting and holding board 21, a plurality of small holes (not shown in the diagram) attract and hold the surface of the label L by air suction at the holes. The attracting and holding board 21 is divided at a line perpendicular to the supplying direction R of the label L that is a line parallel to the folding lines P of the apex portion 3 and the bent portions 6 of the label L, which is configured to provide a pair of divided bodies 21A and 21B which attract and hold the label L by holding the then leading and trailing end portions 7 of the label.

The label sheet manufacturing device includes a folding and temporary attaching unit 30. The folding and temporary attaching unit 30 is provided with an air cylinder unit 22, comprised of cylinder 22*a* and a piston 22*b*, which acts as a transferring unit for transferring the attracting and holding board 21 of the label holding unit 20 between two positions. One position is attracting and holding position X (in FIGS. 1 and 2) where the label attracting and holding board 21 of the label holding unit 20 attracts and holds the label L. The other position is a temporary attaching position Y (in FIG. 3(*b*)) where the label L is attracted and held at the folded portion forming position K by the divided bodies (a first divided body) 21A and (a second divided body) 21B which are temporarily attached to the strip form backing sheet Da conveyed by the later mentioned backing sheet conveyance unit. The cylinder 22*a* of the air cylinder unit 22 is supported by a machine base 15. A fixing board 23 supporting the attracting and holding board 21 is assembled at the end of the piston 22*b*.

Furthermore, in relation to the attracting and holding position X, the temporary attaching position Y, is configured at the downstream side of the conveyance direction R of the strip form backing sheet Da. The air cylinder unit 22 is supported by the machine base 15 so as to transfer the label holding unit 20 from the attracting and holding position X to the temporary attaching position Y in an oblique direction such that the advancing direction of the piston 22*b* is oblique. The air cylinder 22 transfers the label holding unit 20 from the attracting and holding position X towards the temporary attaching position Y in an oblique direction such that the label holding unit 20 moves away from the label supplying unit 10. Therefore, compared to the case where the label holding unit is transferred in a vertical direction or toward the temporary attaching position, it is possible to reliably prevent the interference with the label supplying unit 10.

Furthermore, near the peel-off board 11, an air blowing pipe 24 assists attracting and holding of the label L by the attracting and holding board 21 at the attracting and holding position X of the attracting and holding board 21. The air blowing pipe 24 blows air towards the attracting and holding board 21 side from the back surface side of the label L that has been peeled off by the peel-off board 11. In addition, the air blowing pipe 24, located at the later mentioned separating position J of the second divided body 21B (other divided body), also has a function to press the portion 2 of the label L from the back surface side to the front surface side such that the portion 2 of the label L such that the portions 2 of the label is inserted by protruding in between the first divided body 21A (one divided body) and the second divided body 21B.

Then, the folding and temporary attaching unit 30, at the attracting and holding position X of the attracting and holding board 21 of the label holding unit 20, folds and protrudes a portion of the label L held by the label holding unit 20 from the back surface side to the front surface side in a chevron shape, and forms the folded portion 1 having the first side face 4 and the second side face 5 with the apex portion 3 as a border therebetween. The folding and temporary attaching unit 30 also temporarily attaches outer end portions 7 protruding from the base portion of the first side surface 4 and from the base of the second side surface 5 of the folded portion 1 at the bent portions 6 to the strip form backing sheet Da. The folding and temporary attaching unit 30 constitutes the attracting and temporary holding board 21 comprising the above-mentioned divided bodies 21A and 21B.

In detail, the first divided body 21A is supported against the attachment plate 23 via the supporting member 25. The second divided body 21B is supported such that it is movable along the supplying direction R of the label L. The folding and temporary attaching unit 30 is provided with the air cylinder unit 31 as the folding unit, which causes relative approach and separation of the divided bodies 21A and 21B, and which, at approach of the divided bodies 21A and 21B, forms the folded portion 1 by pressing the bent portions 6 of the label L with the end surfaces 28 at which each divided bodies 21A and 21B are opposing the other, and by folding the part 2 of the label L. This air cylinder unit 31 approaches and separates the second divided body 21B to and from the first divided body 21A. The air cylinder unit 31 is comprised of a cylinder 31*a* fixed to the attachment plate 23, and a piston 31*b* on which the second divided body 21B is assembled. This makes the directions, the label L supplying direction R of the label supplying unit 10 and the approaching and separating direction of the divided bodies 21A and 21B the same.

Furthermore, the folding and temporary attaching unit 30 is provided with a movement control unit (not shown in the diagram) which is achieved by the function of the CPU, etc. controlling the movement of the divided bodies 21A and 21B of the folding unit. The movement control unit positions the moving second divided body 21B to the contacting position S (in solid lines in FIG. 2) where the divided bodies 21A and 21B approach to contact each other when the label L supplied from the label supplying unit 10 is attracted and held, or positions the second divided body to the separating position J (in FIG. 2(*a*) and FIG. 3(*c*)) where the divided bodies 21A and 21B separate from each other enabling folding of the label L, from the contacting position S, and to the folded portion forming position K (in FIGS. 3(*a*) and (*b*)) where the divided bodies 21A and 21B approach each other forming the folded portion 1, from the separating position J. As the label L is attached by abutting the first side face 4 and the second side face 5 of the label L, the folded portion forming position K is set at the same position as the contacting position S where the first side face 4 and the second side face 5 of the label L are abutted.

The separating position J of the divided bodies 21A and 21B is configured to be at a position where the end portion 28*a* (in FIG. 2(*b*)) of the end surfaces 28 of the divided bodies 21A and 21B contact the label L at a location that corresponds to the bent portions 6 of the label L. The first divided body 21A is prepared with a length corresponding to the length of the outer end portions 7 of the label L. The first divided body 21A is set at the same position as the bent portions 6 of the label L supplied from the label supplying unit 10, at the position where the outer end portions 28*a* of the end surfaces 28 contact the label L. The second divided body 21B moves as it attracts and holds the label L and is set such that, at the separating position J, the end portions 28*a* are at the same positions as the bent portions 6 of the label L. At the separating position J, a space is formed between the first divided body 21A and the second divided body 21B in which the portion 2 of the label L protruding from the back surface side to the front surface side can be inserted. Also, at the separating position J, the first divided body 21A and the second divided body 21B attract and hold both outer end portions 7 of the label L supplying direction R respectively.

Figure 5:
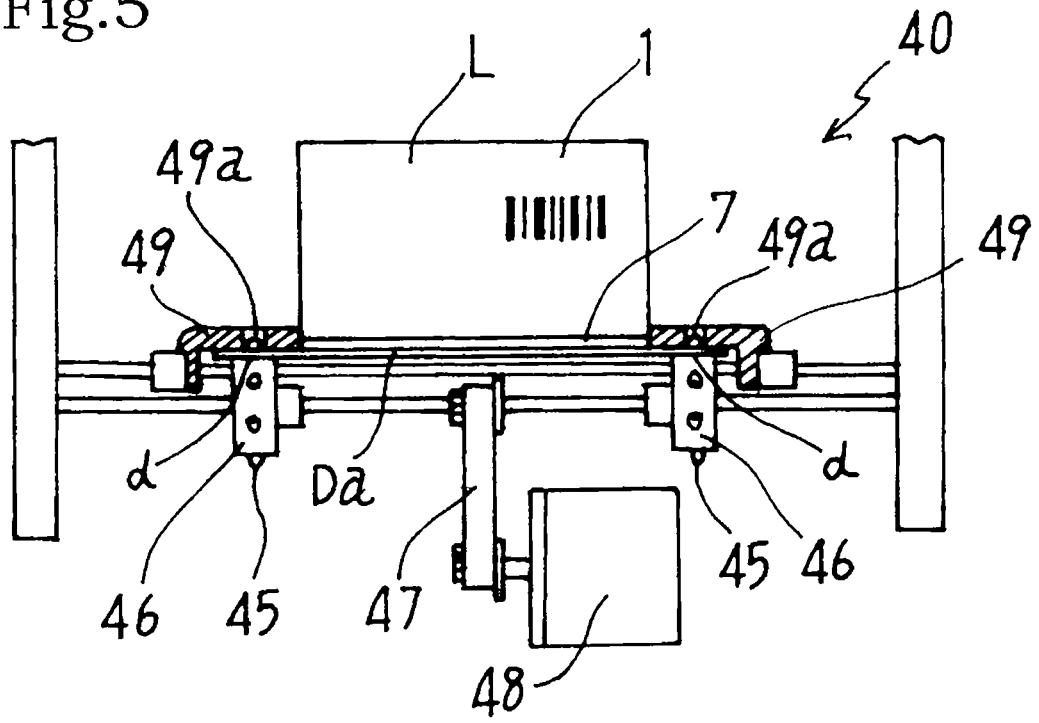
FIG. 5 is a cross-section diagram showing the strip form backing sheet conveyance mechanism of the label sheet manufacturing device in the embodiment of the present invention.

The label sheet manufacturing device includes a backing sheet conveyance unit which conveys the strip form backing sheet Da. As shown in FIGS. 1 and 5, the backing sheet conveyance unit 40 is configured to comprise backing sheet reel holding unit 42 which holds the backing sheet reel 41 with the strip form backing sheet Da wound around rotatably, a strip form backing sheet conveyance mechanism 43 which conveys the strip form backing sheet Da by pulling out the strip form backing sheet Da from the backing sheet reel 41 held by the backing sheet reel holding unit 42, and a supporting board 44 which supports the strip form backing sheet Da conveyed by the strip form backing sheet conveyance mechanism 43 during temporary attachment of the label L by the folding and temporary attaching unit 30.

The strip form backing sheet conveyance mechanism 43, as shown in FIGS. 1 and 5, is provided at the downstream end side of the supporting board 44. The strip form backing sheet conveyance mechanism 43 also comprises a pair of feeding rollers 46 provided with a projecting equally-spaced plurality of pins 45 which are inserted into the holes d at both end edge portions of the strip form backing sheet Da. Furthermore, the strip form backing sheet conveyance mechanism 43 is provided with a motor 48 which intermittently rotates and drives the feeding roller 46 via the belt transmission mechanism 47. In addition, at the upper side of the feeding roller 46, there is a pair of guide members 49 with openings 49*a* facing the pins 45 of the feeding roller 46 as shown in FIGS. 4 and 5, which guides the strip form backing sheet Da from both sides by slidingly contacting both end edge portions of the strip form backing sheet Da.

Furthermore, as shown in FIGS. 1 and 4, at the downstream side of the supporting board 44, a cutting mechanism 50 cuts the strip form backing sheet Da with the label L temporarily attached into a predetermined length. The cutting mechanism 50 is configured to comprise a rotating blade 51 which cuts the strip form backing sheet Da, a supporting member 52 which supports and moves the cutting blade 51 back and forth in the direction perpendicular to the conveying direction of the strip form backing sheet Da, a rail 53 which supports and enables the supporting member 52 to move back and forth, an actuator (not shown) which moves the supporting member 52 back and forth, and a fixed blade 54 opposing the rotating blade 51. In FIG. 1, the reference number 55 represents a stacker which stores the cut label sheets LS.

Therefore, when manufacturing label sheets by the label sheet manufacturing device of the present embodiment, the process is as follows.

First, as shown in FIG. 2(*a*), the attracting and holding plate 21 is positioned at the attracting and holding position X by the air cylinder unit 22, and the second divided body 21B is positioned at the contacting position S (in solid lines in FIG. 2(*a*)) by the air cylinder unit 31.

In this state, when the label L is conveyed from the label supplying unit 10 and then the label L is folded back by the peel-off board 11 peeled off from the strip form backing sheet Db, the attracting and holding board 21 attracts and holds the label L at the attracting and holding position X.

Next, as shown in FIGS. 2(*a*) and 2(*b*), the air cylinder 31 operates and moves the second divided body 21B to the separating position J. In this case, between the first divided body 21A and the second divided body 21B, there is a space in which to insert a portion 2 of the label L protruding from the back surface side (the adhesive layer side) to the front surface side (the indication layer side) is formed.

In this state, as shown in FIGS. 2(*c*) and 3(*a*), the air cylinder 31 operates and moves the second divided body 21B from the separating position J to the folded portion forming position K. Furthermore, at this state, air is blown out from the air blowing pipe 24. Thereby, the folded portion 1 is formed by the first divided body 21A and the second divided body 21B respectively attracting and holding the both outer end portions 7 of the supplying direction R of the label L, and pressing the bent portion 6 of the first side face 4 and the bent portion 6 of the second side face 5 in the direction in which the back surfaces of the first side face 4 and the second side face 5 approach the other. In this case, as the portion 2 of the label L is pushed from the back surface side to the front surface side by the air blowing force from the air blowing pipe 24, the portion 2 of the label L is securely folded in a chevron shape.

Figure 3:
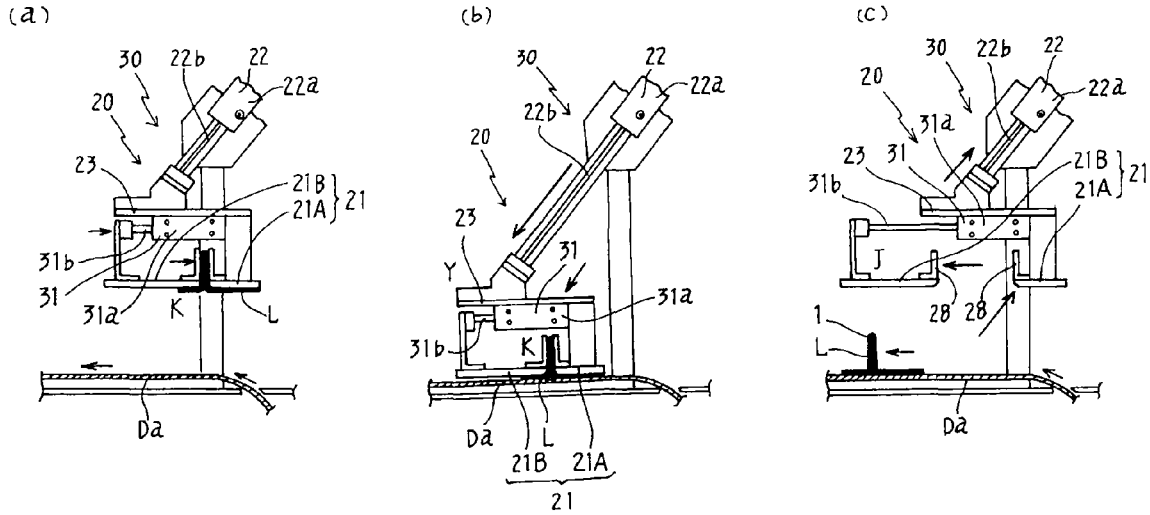
FIG. 3 show a further series of stages of operation of the manufacturing device.

Then, as shown in FIG. 3 (*b*), the air cylinder unit 22 operates and lowers the attracting and holding board 21 from the attracting and holding position X to the temporary attaching position Y, and the attracted and held label L is there temporarily attached to the strip form backing sheet Da. In this case, the both outer end portions 7 of the folded portion 1, which are the portion 2 of the label L protruded in a chevron shape, are pressed to the strip form backing sheet Da by the first divided body 21A and the second divided body 21B, and the label L is thereby securely temporarily attached to the strip form backing sheet Da. After temporarily attaching the label L, as shown in FIG. 3(*c*), the second divided body 21B of the attracting and holding board 21 is positioned at the separating position J. Then the attracting and holding board 21 is raised and returned to the attracting and holding position X by the air cylinder unit 22.

Meanwhile, at the backing sheet conveyance unit 40, by intermittently driving the motor 48 of the strip form backing sheet conveyance mechanism 43, the feeding roller 46 conveys the strip form backing sheet Da for a predetermined length (in the embodiment, it is a predetermined length corresponding to the length of a piece of temporarily attached label L). Then, when the strip form backing sheet Da with the label L temporarily attached reaches the predetermined position of the fixed blade 54, the rotating blade 51 of the cutting mechanism 50 is moved along the fixed blade 54, and the strip form backing sheet Da is cut, and the label sheet LS is produced. In this way, the label sheets LS are sequentially manufactured. The label sheets LS are dropped to the stacker 55 and stored.

When attaching label L to an article using such label sheet LS, the label L is peeled off from the backing sheet D and the outer end portions 7 are attached to the article by manual procedures. In this case, as shown in FIG. 6, as the apex portion 3 and the bent portions 6 of the label L are folded in advance forming the folded portion 1, the label L is temporarily attached to the backing sheet D with the folded portion 1 in a protruding state. Therefore, in the attaching procedure of the label L, it is not required to perform the folding procedure one by one as in the past, but is only required to attach the outer end portions 7 to the article as they are, such that the attaching procedure can be easily performed.

Furthermore, in case a RFID tag T is provided on the label L of the label sheet LS, it is possible to attach the label L more efficiently and easily by manual procedures on articles which cannot be conveyed by a conveyer, etc. such as containers, drums, and iron poles. In addition, as shown in FIG. 6, by configuring the RFID tag T at a position away from the both outer end portions 7, in case the article to which the label is attached is of metals or contains liquid such as water, as these factors which may decrease the radio waves emitted by the tag T are avoided, it is possible to perform good communication with the RFID tag.

In addition, in the label sheet manufacturing device of the above embodiment, by changing the stroke of the air cylinder unit 31 controlled by a movement control unit of the air cylinder 31 accordingly, the label L may be temporarily attached to the backing sheet D by folding the folded portion 1 so as to form a space between the first side face 4 and the second side face 5 of the label L defining an inverted V-shape, and therefore the label may be changed accordingly.

The invention claimed is:

1. A label sheet manufacturing device for manufacturing a label with a fold and wherein the label is detachably attachable to a backing sheet, the label sheet manufacturing device comprising:

a label supply unit configured to supply a planar label along a direction of supply;

a label holding unit configured to attract and hold, at an attract and hold position, the label supplied from the label supply unit, the label holding unit including a holding board comprised of a pair of divided bodies divided at a line and oriented parallel to the direction of supply, and further including end portions, each end portion residing at an end of a respective divided body facing the other end portion, and having an end surface that extends from its associated divided body to a position above its associated divided body;

an air cylinder unit supported on a base and connected to the label holding unit;

a label folding unit configured and operable to fold the label to define a protruding portion of the label which protrudes from a back surface side of the label to a front surface side of the label in a general chevron shape defining both one side surface and the other side surface of the label with an apex defining a border between the one and the other side surfaces, and to fold the label to also define a respective outer end portion projecting from a base portion of each side surface of the label, and each end portion is joined to the respective side surface by a bent portion of the label;

a backing sheet conveyance unit configured to move a backing sheet to an attaching position where a folded label may be temporarily attached to the backing sheet;

a temporary attaching unit at the backing sheet at the attaching position of the conveyance unit and at the folding unit, the temporary attaching unit configured and operable for temporarily attaching the folded label to a receiving region of the backing sheet;

a support board that supports the backing sheet as it is moved; and wherein the backing sheet conveyance unit is configured to move the backing sheet relative to and between the temporary attaching unit and the support board, and wherein the backing sheet conveyance unit comprises a strip form backing sheet conveyance mechanism operable and configured to move the backing sheet away from the temporary attaching unit by engaging the backing sheet at a location outside the receiving region, wherein the attract and hold position and the attaching position are vertically spaced from one another, and wherein the air cylinder unit is oriented to transfer the label holding unit from the attract and hold position to the attaching position in an oblique direction to reliably avoid interference with the label supply unit.

2. The label sheet manufacturing device of claim 1, wherein the label holding unit comprises a pair of divided bodies that are movable toward and away from each other, are configured for attracting and holding the label at the divided bodies and are configured for folding the label;

the folding unit being configured for causing the divided bodies to selectively approach each other and to separate apart from each other, such that with a label held to the divided bodies and upon approach of the divided bodies toward each other, the divided bodies cooperating to form a folded portion of the label by the divided bodies pressing on bent portions of the label at the base of folded side surfaces of the label for folding the label to define side surfaces of the label joined at an apex; and a movement control unit configured to control movement of the divided bodies to approach and separate.

3. The label sheet manufacturing device of claim 2, wherein the backing sheet conveyance unit comprises a backing sheet holding reel configured for holding a backing sheet reel in a strip form while on the reel; and the strip form backing sheet conveyance mechanism is operable and configured to pull the backing strip from the backing sheet reel being held by the backing sheet holding unit.

4. The label sheet manufacturing device of claim 3, further comprising the backing sheet conveyance unit moving in a direction from feeding of the backing sheet from the reel to receiving attachment of the label during movement of the backing sheet by backing sheet conveyance in a downstream direction;

a cutting mechanism downstream of the conveyance mechanism and of the attachment of the label to the backing sheet, the cutting mechanism being configured and operable to cut the strip form backing sheet with temporarily attached labels to respective predetermined length label carrying sections.

5. The label sheet manufacturing device of claim 4, wherein the temporary attaching unit further comprises a transfer unit operable and configured to transfer the label holding unit between two positions thereof including the attracting and holding position at which a label is attracted and held by the label holding unit and the temporary attaching position at which the attracted and held label is then temporarily attached to the backing sheet.

6. The label sheet manufacturing device of claim 3, wherein the temporary attaching unit further comprises a transfer unit operable and configured to transfer the label holding unit between two positions thereof including the attracting and holding position at which a label is attracted and held by the label holding unit and the temporary attaching position at which the attracted and held label is then temporarily attached to the backing sheet;

the backing sheet conveyance unit is configured and operable for moving the backing sheet in a downstream direction, and the temporary attaching unit is operable and configured to define a temporary attaching position for the label which is at a downstream side of the conveying direction which is downstream in the conveying direction of the label holding unit, and the transferring unit is configured to transfer the label holding unit from the attracting and holding position to the temporary attaching position.

7. The label sheet manufacturing device of claim 6, wherein the backing sheet conveyance unit moves the backing sheet past the temporary attaching position in a first conveyance direction and the transferring unit is supported and operable and configured to transfer the label holding unit from the attracting and holding position toward the temporary attaching position of the label in an oblique direction toward the backing strip moving in the first conveyance direction and also toward the temporary attaching position on the backing sheet.

8. The label sheet manufacturing device according to claim 1, wherein the strip form backing sheet conveyance includes two feeding rollers each positioned and configured to engage a respective edge of the backing sheet.

9. The label sheet manufacturing device according to claim 8, wherein each feeding roller includes a plurality of pins that are receivable in holes defined at edges of the backing sheet.

10. A label sheet manufacturing device for manufacturing a label with a fold and wherein the label is detachably attachable to a backing sheet, the label sheet manufacturing device comprising:

a label supply unit configured to supply a planar label along a direction of supply;

a label holding unit configured to attract and hold, at an attract and hold position, the label supplied from the label supply unit, the label holding unit including a holding board comprised of a pair of divided bodies divided at a line and oriented parallel to the direction of supply, and further including end portions, each end portion residing at an end of a respective divided body facing the other end portion, and having an end surface that extends from its associated divided body to a position above its associated divided body;

a label folding unit configured and operable to fold the label to define a protruding portion of the label which protrudes from a back surface side of the label to a front surface side of the label in a general chevron shape defining both one side surface and the other side surface of the label with an apex defining a border between the one and the other side surfaces, and to fold the label to also define a respective outer end portion projecting from a base portion of each side surface of the label, and each end portion is joined to the respective side surface by a bent portion of the label;

a backing sheet conveyance unit configured to move a backing sheet to an attaching position where a folded label may be temporarily attached to the backing sheet;

a temporary attaching unit at the backing sheet at the attaching position of the conveyance unit and at the folding unit, the temporary attaching unit configured and operable for temporarily attaching the folded label to the backing sheet in a detachable manner, the folded label including an RFID tag;

a support board that supports the backing sheet as it is moved; and a cutting mechanism downstream of the conveyance mechanism and of the temporary attaching unit, the cutting mechanism being configured and operable to cut the strip form backing sheet with temporarily attached labels to respective predetermined length label carrying sections;

wherein the backing sheet conveyance unit is configured to move the backing sheet relative to and between the temporary attaching unit and the support board;

wherein the backing sheet conveyance unit moves the backing sheet from a location upstream of the temporary attaching unit to a location down stream of the temporary attaching unit toward the cutting mechanism;

and wherein the folded label will include an extended portion that extends away from the backing sheet after it has been detachably attached to the backing sheet, the folded label is conveyed by the conveyance unit with the extended portion extending away from the backing sheet, and the extended portion remains extending away from a carrying section to which it is detachably attached after cutting by the cutting mechanism, wherein the attract and hold position and the attaching position are vertically spaced from one another, and wherein the air cylinder unit is oriented to transfer the label holding unit from the attract and hold position to the attaching position in an oblique direction to reliably avoid interference with the label supply unit.

11. The label sheet manufacturing device according to claim 10, wherein the backing sheet is conveyed from a reel.

* * * * *

UNITED STATES PATENT AND TRADEMARK OFFICE

CERTIFICATE OF CORRECTION

PATENT NO. : 8,695,670 B2
APPLICATION NO. : 12/744209
DATED : April 15, 2014
INVENTOR(S) : Barczyk et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 309 days.

Signed and Sealed this
Twenty-ninth Day of September, 2015

Michelle K. Lee

Michelle K. Lee
*Director of the United States Patent and Trademark Office*